US007786961B2

(12) United States Patent
Yoon et al.

(10) Patent No.: US 7,786,961 B2
(45) Date of Patent: Aug. 31, 2010

(54) LIQUID CRYSTAL DISPLAY DEVICE AND METHOD FOR DRIVING THE SAME

(75) Inventors: Jin-Mo Yoon, Seoul (KR); Bu-Yeol Lee, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 986 days.

(21) Appl. No.: 11/583,258

(22) Filed: Oct. 19, 2006

(65) Prior Publication Data

US 2007/0146272 A1 Jun. 28, 2007

(30) Foreign Application Priority Data

Oct. 19, 2005 (KR) ..... 10-2005-0098561

(51) Int. Cl.
*G09G 3/36* (2006.01)

(52) U.S. Cl. ..... 345/87

(58) Field of Classification Search ..... None
See application file for complete search history.

*Primary Examiner*—Sumati Lefkowitz
*Assistant Examiner*—Tammy Pham
(74) *Attorney, Agent, or Firm*—Brinks Hofer Gilson & Lione

(57) ABSTRACT

A liquid crystal display device and method for driving the same are provided. A liquid crystal display device includes a driving circuit that includes a data driver that is inputted with a m-bit data signal. The data driver is operative to extract a n-bit data signal from the m-bit data signal and a (m-n)-bit data signal, and adjust a gray level of the (m-n)-bit data signal using the n-bit data signal. A liquid crystal panel includes a pixel that is supplied with the (m-n)-bit data signal during a plurality of frames.

16 Claims, 4 Drawing Sheets

| | f0 | f1 | f2 | f3 |
|---|---|---|---|---|
| 00 | 0 | 0 | 0 | 0 |
| 01 | 0 | 0 | 0 | 1 |
| 10 | 0 | 1 | 0 | 1 |
| 11 | 0 | 1 | 1 | 1 |

| | A | B | C | D |
|---|---|---|---|---|
| 00 | X | X | X | X |
| 01 | X | X | X | X+1 |
| 10 | X | X+1 | X | X+1 |
| 11 | X | X+1 | X+1 | X+1 |

LIQUID CRYSTAL DISPLAY DEVICE AND METHOD FOR DRIVING THE SAME

This application claims the benefit of Korean Patent Application No. 2005-98561, filed on Oct. 19, 2005, which is hereby incorporated by reference for all purposes as if fully set forth herein.

BACKGROUND

1. Field

The present embodiments relate to a liquid crystal display device and method for driving the same.

2. Related Art

Conventionally, cathode-ray tubes (CRTs) have been widely used as display devices. Research and development of various types of flat panel displays as a substitutes for CRTs has been conducted. For example, liquid crystal display (LCD) devices, plasma display panels (PDPs), field emission displays (FED), and electro-luminescence displays (ELDs) have been developed. These flat panel displays are driven by an active matrix driving method with a plurality of pixels arranged in a matrix configuration that are driven using a plurality of thin film transistors therein. Among these active matrix type flat panel displays, liquid crystal display (LCD) devices and electroluminescent display (ELD) devices are widely used for notebook computers and desktop computers because of their high resolution, ability to display colors and superiority in displaying moving images.

Generally, an LCD device includes two substrates that are spaced apart and face each other with a layer of liquid crystal molecules interposed between the two substrates. The two substrates include electrodes that face each other. A voltage is applied between the electrodes that induce an electric field across the layer of liquid crystal molecules. The alignment of the liquid crystal molecules changes in accordance with the intensity of the induced electric field, for example, changes the light transmissivity of the LCD device. The LCD device displays images by varying the intensity of the electric field across the layer of liquid crystal molecules.

As shown in FIGS. 1 and 2, a LCD device includes a liquid crystal panel 2, a driving circuit 26, an interface 10 and a power supply 14. The driving circuit 26 includes gate and data drivers 20 and 18, a timing controller 12, and a gamma reference voltage generator 16.

A liquid crystal panel 2 includes a plurality of gate lines GL1 to GLn along a row direction and a plurality of data lines DL1 to DLm along a column direction. The gate lines GL1 to GLn and the data lines DL1 to DLm cross each other to define a plurality of pixels. Each pixel includes a thin film transistor TFT and a liquid crystal capacitor LC. The liquid crystal capacitor LC includes a pixel electrode, a common electrode and a liquid crystal layer between the pixel and common electrodes.

Data signals and control signals are inputted into the interface 10 from an exterior system such as a computer. The data signals and control signals are, for example, a vertical synchronization signal (vsync), a horizontal synchronization signal (hsync) and/or a data clock (dck). The interface 10 supplies the data and control signals to the timing controller 12. The timing controller 12 generates control signals that control the gate and data drivers 20 and 18 and supplies data signals to the data driver 18. The gamma reference voltage generator generates gamma reference voltages used for a DAC (digital to analog converter) in the data driver 18.

The data driver 18 outputs data voltages corresponding to the data signals to the data lines DL1 to DLm. The gate driver 2 outputs gate voltages to the gate lines GL1 to GLn.

On-level gate voltages are sequentially applied to the gate lines GL1 to GLn to enable the gate lines GL1 to GLn and the thin film transistors TFT connected to the gate lines GL1 to GLn. For example, when the thin film transistors TFT are turned on, the data voltages are applied to the pixels through the data lines DL1 to DLm. Accordingly, an electric field is applied to the liquid crystal and the light transmissivity of the liquid crystal layer changes, thereby displaying images.

A power supply 14 generates driving voltages for the driving circuit 26 and the common voltage for the common electrode of the liquid crystal panel 2.

The driving circuit 26 is formed directly in the liquid crystal panel 2 using a low temperature poly-crystalline silicon (LTPS) method.

Generally, the data driver is operated with an 8-bit driving method instead of 6-bit driving method. When the LTPS method is applied to the LCD device with the 8-bit driving method, the LCD device with the 8-bit driving method needs more space for the driving circuit than the LCD device with the 6-bit driving method. This causes inefficiency of the space for the driving circuit, difficulty of panel design, increase of product cost and the like.

SUMMARY

The present embodiments may obviate one or more of the problems due to limitations and disadvantages of the related art.

In one embodiment, a liquid crystal display device includes a driving circuit that includes a data driver that is inputted with a m-bit data signal, extracts a (m-n)-bit data signal and a n-bit data signal from the m-bit data signal, and adjusts a gray level of the (m-n)-bit data signal using the n-bit data signal. A liquid crystal panel includes a pixel that is supplied with the (m-n)-bit data signal during a plurality of frames.

In an alternate embodiment, a method of driving a liquid crystal display device includes inputting a m-bit data signal to a data driver; extracting a (m-n)-bit data signal and a n-bit data signal from the m-bit data signal; adjusting a gray level of the (m-n)-bit data signal using the n-bit data signal; and supplying the (m-n)-bit data signal to a pixel of a liquid crystal panel during a plurality of frames.

It is to be understood that both the foregoing general description and the following detailed description are exemplary and explanatory and are only intended to provide a further explanation of the present embodiments as claimed.

DETAILED DESCRIPTION

Figure 1:
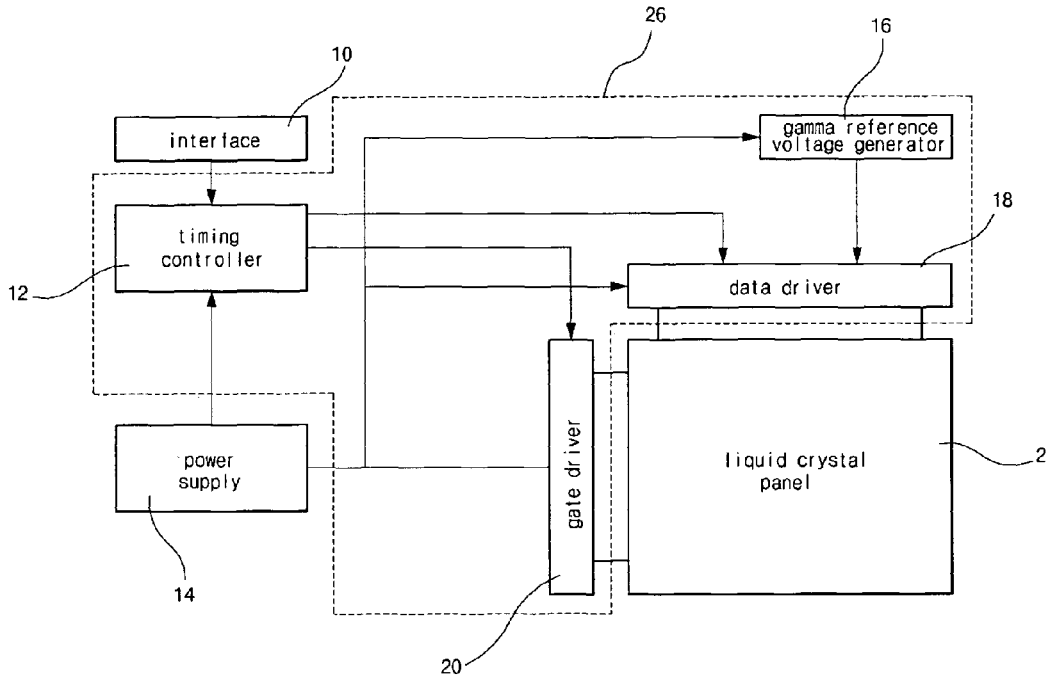
FIG. 1 RELATED ART
FIG. 1 is a block diagram that illustrates an LCD device according to the related art.
Figure 2:
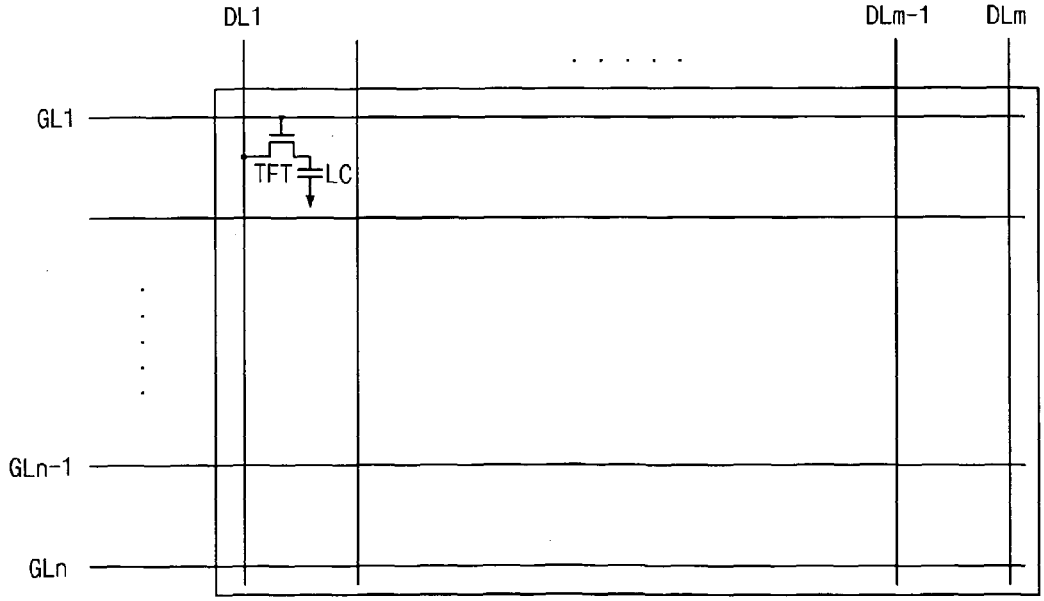
FIG. 2 RELATED ART
FIG. 2 is a circuit diagram that illustrates a liquid crystal panel of FIG. 1.
Figures 3, 4:
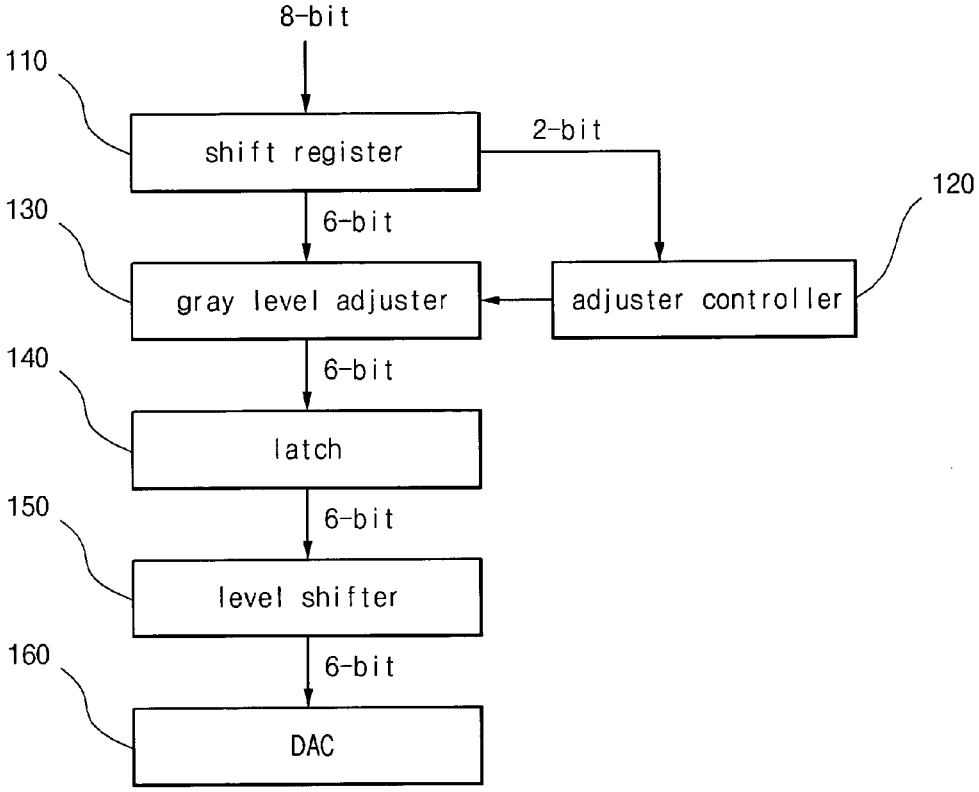
FIG. 3 is a block diagram that illustrates a data driver of an LCD device according to one embodiment.
FIG. 4 illustrates the LUT of the adjuster controller of FIG. 3.

FIG. 3 is a block diagram that illustrates a data driver of an LCD device according to one embodiment. The LCD device of FIG. 3 is similar to that of FIGS. 1-2, except for the data driver. Accordingly, explanations of similar parts may be omitted. In the LCD device of FIG. 3, the driving circuit may be formed directly in the liquid crystal panel using an LTPS method.

In one embodiment, as shown in FIG. 3, the data driver is operated with an m-bit data driving method using a (m-n)-bit data driving circuit. The data driver includes a shift register 110, a gray level adjuster 130, an adjuster controller 120, a latch 140, a level shifter 150 and a DAC (digital to analog converter) 160. The shift register 110 is for m-bit, and the gray level adjuster 130, the latch 140, the level shifter 150 and the DAC are for (m-n)-bit. In one exemplary embodiment, m and n, for example, are 8 and 2, respectively.

An 8-bit data signal for a corresponding pixel is inputted into the shift register 110. The shift register 110 stores the 8-bit data signal. The shift register 110 divides the 8-bit data signal. The divided data signal is supplied to different circuits, for example, the gray level adjuster 130 and the adjuster controller 120. For example, an upper 6-bit data signal of the 8-bit data signal is supplied to the gray level adjuster 130, and a lower 2-bit data signal of the 8-bit data signal is supplied to the adjuster controller 120.

In one embodiment, the lower 2-bit data signal is input into the adjuster controller 120. The adjuster controller 120 outputs a control signal to the gray level adjuster 130. The control signal is generated using the lower 2-bit data signal and a pixel state. The control signal controls a gray-level-adjusting operation of the gray level adjuster 130. In one embodiment, the adjuster controller 120 uses a look-up-table (LUT) where values of the control signal are set up according to values of the lower 2-bit data signal and pixel states.

FIG. 4 illustrates an example of the LUT of the adjuster controller of FIG. 3.

In one embodiment, as shown in FIGS. 3 and 4, when the lower bit data signal has 2 bits, four ($2^2$) pixel states f0 to f3 exist. The four pixel states f0 to f3 are repeated by four frames. The gray level of the upper 6-bit data signal is adjusted in each frame, for example, according to a combination of the lower 2-bit data signal and the pixel state. By performing the gray-level-adjusting operations of the upper 6-bit data signal during the four frames, the 8-bit data signal is displayed in the corresponding pixel.

In one embodiment, a gray-level-adjusting amount between when the control signal having a value of "0" and when the control signal having a value of "1" is different. The gray-level-adjusting amount when the control signal is "1" is higher than that when the control signal is "0". For example, the gray level is upgraded when the control signal is "1", and the gray level remains the same when the control signal is "0". The control signal that is "1" enables the gray-level-adjusting operation of the gray level adjuster 130 to adjust the gray level, and the control signal that is "0" disables the gray-level-adjusting operation of the gray level adjuster 130 to maintain the gray level.

In one exemplary embodiment, in the first frame, the pixel has the first state f0, and the control signal is "0" for all lower 2-bit data signals. In the second frame, the pixel has the second state f1, and the control signal is "0" for the lower 2-bit data signals of "00" and "01" and is "1" for the lower 2-bit data signals of "10" and "11". In the third frame, the pixel has the third state f2, and the control signal is "0" for the lower 2-bit data signal of "00", "01" and "10" and is "1" for the lower 2-bit data signal of "11". In the fourth frame, the pixel has the fourth state f3, and the control signal is "0" for the lower 2-bit data signal of "00" and is "1" for the lower 2-bit data signals of "01", "10" and "11".

In one embodiment, the adjuster controller 120 generates the control signal using the lower 2-bit data signal and the pixel states to perform the gray-level-adjusting operations for the upper 6-bit data signal during the multiple frames. When the lower n-bit data signal is extracted from the shift register 110, $2^n$ pixel states and $2^n$ frames may be required to display the m-bit data signal, which is inputted to the shift register 110, in the corresponding pixel.

In one exemplary embodiment, the gray level adjuster 130 adjusts the gray level of the 6-bit data signal according to the control signal outputted from the adjuster controller 120. The gray level adjuster 130 includes a calculator, for example, an adder. When the adder is used, the adder may add one gray level to the 6-bit upper data signal for the control signal of "1" and pass the 6-bit upper data signal without an adding operation for the control signal of "0".

In one embodiment, the upper 6-bit data signal outputted from the gray level adjuster 130 is supplied to the corresponding pixel through the latch 140, the level shifter 150 and the DAC 160.

Figures 5, 6:
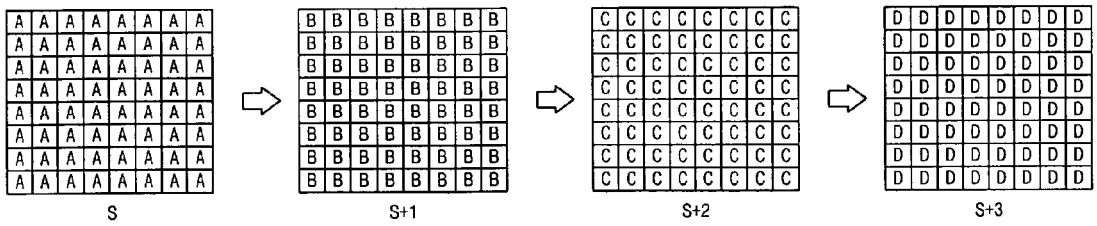
FIG. 5 illustrates an example of the LUT of the adjuster controller according to one embodiment.
FIG. 6 illustrates an example where all pixels have the same pixel state in each frame.

FIG. 5 is a view that illustrates an example of the LUT of the adjuster controller according to one embodiment. FIG. 6 is a view that illustrates an example where all pixels have the same pixel state in each frame.

In one embodiment, as shown in FIG. 5, when a lower 2-bit data signal is inputted to an adjuster controller (120 of FIG. 3), four pixel states A to D exist for four frames S to (S+3). When a control signal has a value of "X", a gray level adjuster (130 of FIG. 3) may adjust a gray level of an upper 6-bit data signal into a predetermined gray level or maintain the gray level (i.e. do not adjust). In one exemplary embodiment, when the control signal has a value of "X+1", the gray level adjuster adjust (upgrades) the gray level of the upper 6-bit data signal by one gray level more than the gray level when the control signal has a value of "X".

As shown in FIG. 6, the pixel states A to D are repeatedly changed for all pixels in the same manner, for example, A then B then C then D (A→B→C→D) as the frames S to (S+3) proceed. As the frame is changed from (S+3) to (S+4), the pixel states for all pixels are changed from D to A. When the pixel states are changed from D to A, gray levels of pixels for the lower 2-bit data signals that are "01", "10" and "11" are downgraded instantly. As the pixels for the lower 2-bit data signals that are "01", "10" and "11" increases, brightness is also reduced instantly. This may cause a flicker.

To reduce the flicker, the different pixel states may be uniformly distributed to all pixels in each frame. A method of uniformly distributing the pixel states is explained with reference to FIGS. 7 and 8.

Figure 7:
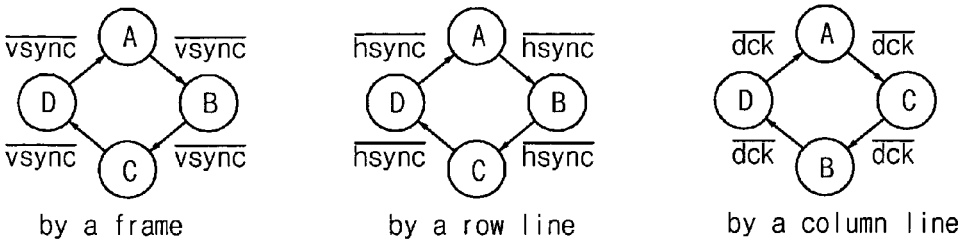
FIG. 7 illustrates a method of changing pixel states by a frame, a row line and a column line according to one embodiment.
Figure 8:
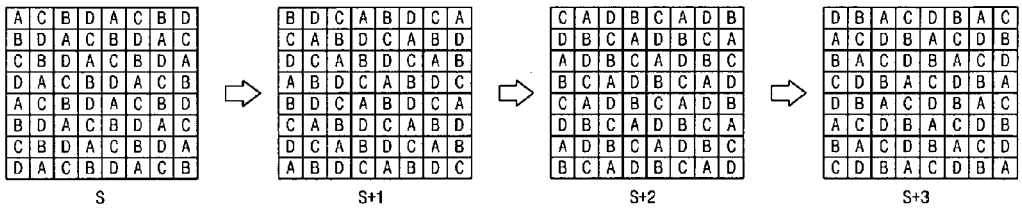
FIG. 8 illustrates an example where all pixels have different pixel states in each frame by the method of FIG. 7.

FIG. 7 illustrates a method of changing pixel states by a frame, a row line and by a column line according to one embodiment. FIG. 8 illustrates an example where all the pixels have different pixel states in each frame by the method of FIG. 7.

As shown in FIG. 7, four pixel states A to D are circulated for each pixel in a manner, for example, A then B then C then D (i.e. A→B→C→D), by a frame (by a vertical synchronization signal vsync). In one embodiment, as shown in FIG. 8, each pixel repeatedly has four states A to D by four frames S to (S+3) according to the pixel state circulation by a frame, as illustrated in FIG. 7.

As shown in FIG. 7, four pixel states A to D are circulated for pixels in each column line in a manner, for example, A then B then C then D (i.e. A→B→C→D), by a row line (by a horizontal synchronization signal hsync). In one embodiment, as shown FIG. 8, pixels in each column repeatedly has four states A to D in each frame according to the pixel state circulation by a row line, as illustrated in FIG. 7.

As shown in FIG. 7, four pixel states A to D are circulated for pixels in each row line in a manner, for example, A then C then B then D (i.e. A→B→C→D), by a column line (by a data clock dck). In one embodiment, as shown FIG. 8, pixels in each row line repeatedly has four states A to D in each frame according to the pixel state circulation by a column line, as illustrated in FIG. 7.

In one embodiment, each pixel repeatedly has the four pixel states by four frames according to the pixel state circulation by a frame. The pixel state circulation by a row line is different from the pixel state circulation by a column line. Adjacent pixels have different pixel states in each frame, for example, the four pixel states are uniformly distributed. For example, when the frames are changed, a instant gray level change is reduced, and thus flicker is reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a driving circuit having a data driver that includes a m-bit data signal, wherein the data driver is operative to extract a 2-bit data signal and a (m−2)-bit data signal from the m-bit data signal, and adjust a gray level of the (m−2)-bit data signal using the 2-bit data signal; and a liquid crystal panel including a pixel that is supplied with the (m−2)-bit data signal during a plurality of frames, wherein the driving circuit generates a first control signal maintaining the gray level of the (m−2)-bit data signal and a second control signal upgrading the gray level of the (m−2)-bit data signal using the 2-bit data signal, wherein the pixel has one of a first pixel state where "00," "01," "10" and "11" of the 2-bit data signal correspond to the first control signal, a second pixel state where "00" and "01" of the 2-bit data signal correspond to the first control signal and "10" and "11" of the 2-bit data signal correspond to the second control signal, a third state where "00," "01" and "10" of the 2-bit data signal correspond to the first control signal and "11" of the 2-bit data signal corresponds to the second control signal, and a fourth state where "00" of the 2-bit data signal corresponds to the first control signal and "01," "10" and "11" of the 2-bit data signal correspond to the second control signal, and wherein the first to fourth states are circulated such that the first state then the second state then the third state then the fourth state by a frame, the first state then the second state then the third state then the fourth state by a row line, and the first state then the third state then the second state then the fourth state by a column line.

2. The device according to claim 1, wherein the data driver includes:

a shift register that is operative to receive the m-bit data signal;

a gray level adjuster that is operative to receive the (m−2)-bit data signal and adjust the gray level of the (m−2)-bit data signal;

an adjuster controller that is operative to receive the 2-bit data signal and generate the first and second control signals.

3. The device according to claim 2, wherein the 2-bit data signal is lower bits of the m-bit data signal, and the (m−2)-bit data signal is upper (m−2) bits of the m-bit data signal.

4. The device according to claim 3, wherein the adjuster controller includes a look up table where the first and second control signals are tablized according to a combination of a value of the 2-bit data signal and the first to fourth pixel states, a number of the first to fourth pixel states being the same as a number of the plurality of frames.

5. The device according to claim 4, wherein the gray level adjuster includes an adder, and the first control signal has a first value that disables an operation of the adder and the second control signal has a second value that enables an operation of the adder.

6. The device according to claim 5, wherein the adder increases the gray level of the (m−2)-bit data signal by one gray level according to the second control signal.

7. The device according to claim 4, wherein the adjacent pixels have different ones of the first to fourth pixel states.

8. The device according to claim 1, wherein the driving circuit is in the liquid crystal panel.

9. The device according to claim 8, wherein the driving circuit further includes a timing controller, a gate driver and a gamma reference voltage generator.

10. The device according to claim 2, wherein the data driver further includes a latch, a level shifter and a DAC processing the (m−2)-bit data signal outputted from the gray level adjuster.

11. A method of driving a liquid crystal display device, comprising:

inputting a m-bit data signal to a data driver;

extracting a (m−2)-bit data signal and a 2-bit data signal from the m-bit data signal;

generating a first control signal for maintaining a gray level of the (m−2)-bit data signal and a second control signal for upgrading the gray level of the (m−2)-bit data signal using the 2-bit data signal;

adjusting the gray level of the (m−2)-bit data signal using the 2-bit data signal; and supplying the (m−2)-bit data signal to a pixel of a liquid crystal panel during a plurality of frames, wherein the pixel has one of a first pixel state where "00," "01," "10" and "11" of the 2-bit data signal correspond to the first control signal, a second pixel state where "00" and "01" of the 2-bit data signal correspond to the first control signal and "10" and "11" of the 2-bit data signal correspond to the second control signal, a third state where "00," "01" and "10" of the 2-bit data signal correspond to the first control signal and "11" of the 2-bit data signal corresponds to the second control signal, and a fourth state where "00" of the 2-bit data signal corresponds to the first control signal and "01," "10" and "11" of the 2-bit data signal correspond to the second control signal, and wherein the first to fourth states are circulated such that the first state then the second state then the third state then the fourth state by a frame, the first state then the second state then the third state then the fourth state by a row line, and the first state then the third state then the second state then the fourth state by a column line.

12. The method according to claim 11, wherein the 2-bit data signal is the lower n-bits of the m-bit data signal, and the (m−2)-bit data signal is upper (m−2) bits of the m-bit data signal.

13. The method according to claim 12, wherein the first and second control signals are tablized according to a combination of a value of the 2-bit data signal and the first to fourth a-pixel states, a number of the first to fourth pixel states being the same as the number of the plurality of frames.

14. The method according to claim 13, wherein adjusting the gray level of the (m−2)-bit data signal includes adding the gray level of the (m−2)-bit data signal, and the first control signal has a first value that disables the adding operation and the second control signal has a second value that enables the adding operation.

15. The method according to claim 14, wherein the gray level of the (m−2)-bit data signal increases by one gray level according to the second control signal.

16. The method according to claim 13, wherein the adjacent pixels have different ones of the first to fourth pixel states.

* * * * *

UNITED STATES PATENT AND TRADEMARK OFFICE

CERTIFICATE OF CORRECTION

PATENT NO. : 7,786,961 B2
APPLICATION NO. : 11/583258
DATED : August 31, 2010
INVENTOR(S) : Jin-Mo Yoon et al.

It is certified that error appears in the above-identified patent and that said Letters Patent is hereby corrected as shown below:

In the Claims

Column 7, claim 12, line 4, after "data signal is" replace "the lower n-bits of the m-bit" with --lower bits of the m-bit--.

Signed and Sealed this
Twenty-fifth Day of January, 2011

David J. Kappos

David J. Kappos
*Director of the United States Patent and Trademark Office*